US005148743A

United States Patent [19]

Zimmer

[11] Patent Number: 5,148,743

[45] Date of Patent: Sep. 22, 1992

[54] COATING MACHINE WITH MAGNETICALLY OPERATED DOCTOR BLADE (SQUEEGEE)

[76] Inventor: Johannes Zimmer, Ebentaler Str. 133, A-9020 Klagenfurt, Austria

[21] Appl. No.: 635,116

[22] PCT Filed: Jun. 6, 1990

[86] PCT No.: PCT/AT90/00056

§ 371 Date: Feb. 15, 1991

§ 102(e) Date: Feb. 15, 1991

[87] PCT Pub. No.: WO90/15717

PCT Pub. Date: Dec. 27, 1990

[30] Foreign Application Priority Data

Jun. 16, 1989 [AT] Austria ..... 1482/89

[51] Int. Cl.[5] ..... B41L 13/06

[52] U.S. Cl. ..... 101/123; 101/120; 101/124

[58] Field of Search ..... 101/114, 119, 121, 123, 101/124, 126, 129

[56] References Cited

U.S. PATENT DOCUMENTS

| | | | |
|---|---|---|---|
| 3,196,784 | 7/1965 | Kraft | 101/123 |
| 3,216,349 | 11/1965 | Kraft | 101/123 |
| 4,090,443 | 5/1978 | Gasser | 101/123 |
| 4,557,194 | 12/1985 | Zimmer | 101/120 |

FOREIGN PATENT DOCUMENTS

| | | | |
|---|---|---|---|
| 321322 | 3/1975 | Austria . | |
| 2197735 | 3/1974 | France | 101/123 |
| 2490999 | 4/1982 | France | 101/123 |

*Primary Examiner*—Edgar S. Burr
*Assistant Examiner*—Eric P. Raciti
*Attorney, Agent, or Firm*—Andrew Wilford; Herbert Dubno

[57] ABSTRACT

In a coating machine in which a doctor blade is magnetically applied, at least one strap or profiled section is tensioned longitudinally or transversely with a supporting surface for the conveyor belt or a substrate web. Between this strap or section and the magnet table on the one hand, and the conveyor belt and the substrate web, on the other hand, a relative movement is produced.

8 Claims, 2 Drawing Sheets

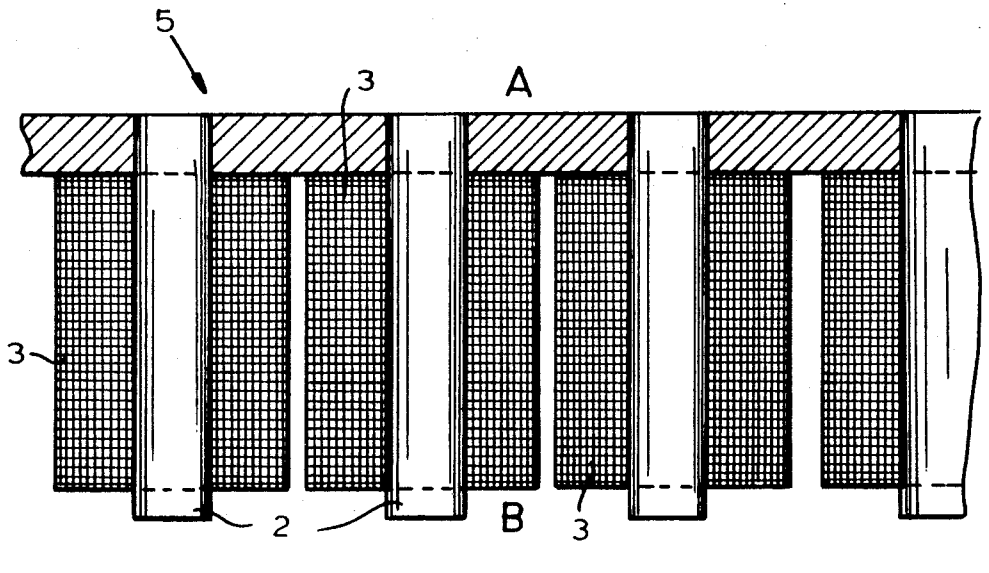
FIG.1 PRIOR ART
FIG.2 PRIOR ART
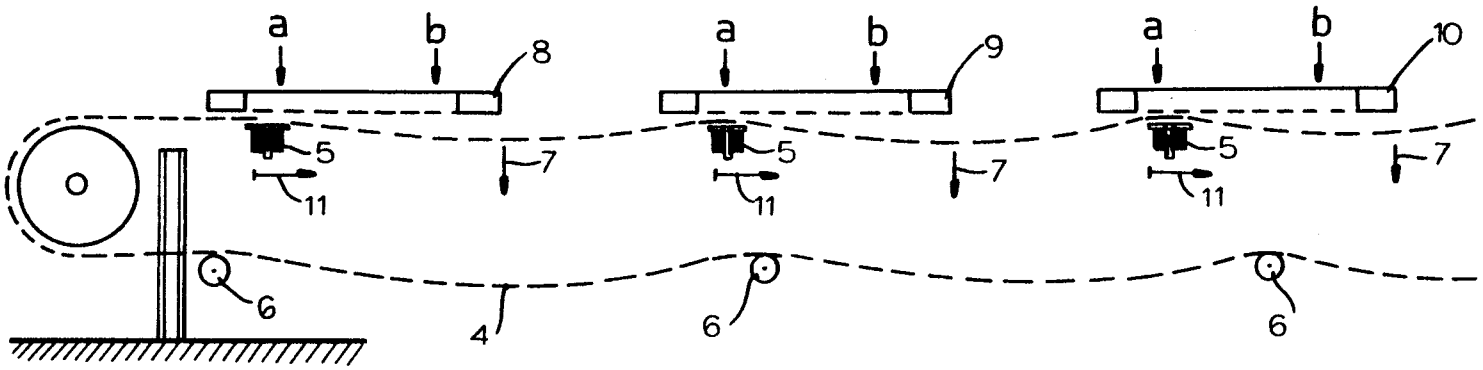
FIG.3 PRIOR ART

COATING MACHINE WITH MAGNETICALLY OPERATED DOCTOR BLADE (SQUEEGEE)

CROSS REFERENCE TO RELATED APPLICATION

This application is a National Phase application of PCT/AT90/0056 filed Jun. 6, 1990 and based upon Austrian National application A 1482/89 filed Jun. 16, 1989 under the International Convention.

The present invention relates to a coating machine with magnetically produced pressure of the doctor blade (squeegee). For the purposes of this description, a "coating machine" is a printing machine, e.g. a flat-bed screen printing machine or a drum-type screen printing machine, or also a full-surface coating machine, i.e. one which works on the entire surface without pattern printing. The substrate to be coated is a so-called web of material, i.e. a flat structure, for instance of textile material, paper, plastic material or the like, the substrate can for instance be also a carpet or another type of floor covering, wall covering or the like, a web of sheet metal or a transmission belt. In any case, the coating procedure takes place in connection with a relative motion of at least one of the application devices built into a coating machine of the invention and the substrate.

Since the element performing the coating is pressed by magnetic force against the substrate or the stencil it can be either a doctor roller, a spreading doctor blade, a spreading knife or the like, made of a magnetizable material or at least provided with parts of magnetizable material.

The basic aim of the invention is to place the web of material (substrate) in the coating machine so that it is flattened in the optimal position required by the coating process. This was, respectively is not possible according to the present state of the art, because in the coating machine the substrate web sags more or less, upstream or downstream of the application device. This sagging of the substrate web impairs the quality of the application process; this is particularly valid for application devices with magnetically operated doctor blades in flat-bed screen printing machines. In such printing machines, the coating process takes place alternately in two opposite travel directions. Therefore, in each travel direction and in each travel path section of each steep application stretch different sagging situations occur, which results in various contact portions, respectively contact times between the device generating the magnetic force, a narrow table — it is also possible to use a magnetic roller instead of such a magnetic table — and the bottom side of the stencil, which during the application process rests against the substrate web.

This functional disadvantage or construction drawback, cannot be eliminated or avoided either by stretching the substrate web in the coating machine or by providing the coating machine with an endless conveyor belt supporting the substrate. The known physical laws relating to catenaries.

BACKGROUND OF THE INVENTION

Application devices with magnetic tables for printing machines are known in a variety of construction types, so that a detailed description can here be omitted.

The fact that coating machines equipped with magnetically operated application devices, particularly flat-bed screen printing machines of the aforedescribed construction have been known for decades and are widely introduced on the world market and in use, and that during this time a great deal of effort has been invested in order to efficiently eliminate the aforedescribed construction and operation drawbacks without leading to a satisfactory solution, proves the need for improvement.

SUMMARY OF THE INVENTION

This is characterized in that in a coating machine equipped with at least one magnetically operated application device, or a doctor blade device of the kind known per se and in any case having also a conveyor belt, at least one support strap or a profiled section is held or stretched at the ends and cooperating with a magnetic table or the like, equipped with at least one element generating magnetic force. The upper side of this support strap or profiled section strapped into the coating machine is arranged in the same plane as the surface of the magnetic table, so that these two cooperating construction components of the coating machine constitute the support plane for the substrate web or for the substrate carrying conveyor belt.

BRIEF DESCRIPTION OF THE DRAWINGS

The above and other objects, features and advantages of the invention will become more readily apparent from the following description, reference being made to diagrammatic drawings, in which:

FIG. 1 is a cross-section taken along line A–B in FIG. 2 through a magnetic table according to the prior art;

FIG. 2 is a transverse section of the machine illustrated in FIG. 1 according to the prior art;

FIG. 3 is a diagrammatic side view of the machine according to the prior art;

SPECIFIC DESCRIPTION

Figure 5:
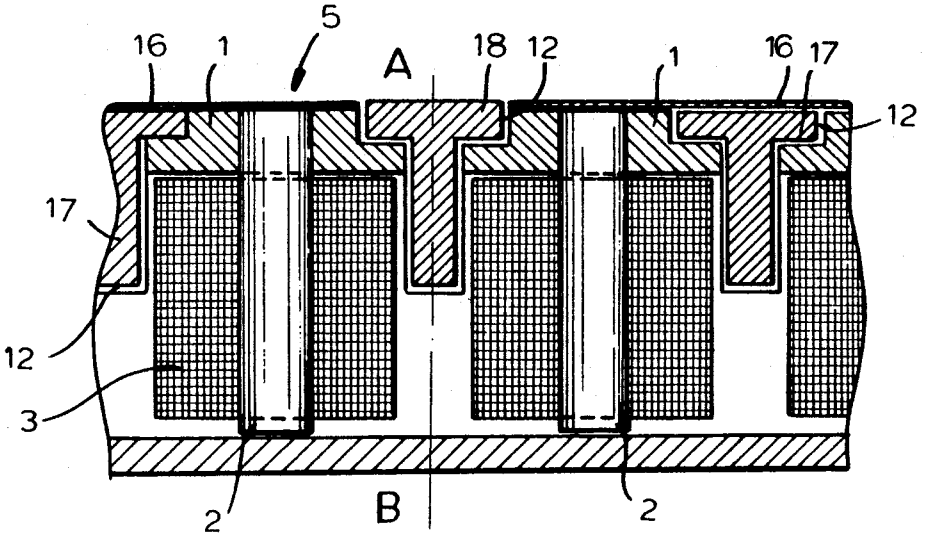
FIG. 5 is a transverse section of the machine illustrated in FIG. 4 according to the invention.

FIG. 1 shows a section along line A–B of FIG. 2 through a magnetic table consisting of a table surface 1, the magnet core 2 and the magnet coil 3.

FIG. 2 shows a cutout from the longitudinal section C–D according to FIG. 1 of the same magnet table 5, which has been represented in cross section in FIG. 1. This cutout shows four magnet cores 2 with magnet coils 3, whereby the fourth coil is only halfway visible.

FIG. 3 shows a schematic longitudinal section through a part of a coating machine, equipped with an endless conveyor belt 4. In this part of a coating machine shown in FIG. 3, which is a flat-bed screen printing machine, three flat stencils 8, 9, 10 are illustrated. Underneath each of these stencils 8, 9, 10, namely in the area a of the path section magnetic table 5 of the construction type shown in FIG. 1 is represented at a reduced scale, corresponding to FIG. 3.

The conveyor belt 4 rests with its lower part on three support rollers 6 and in its upper part on these three aforedescribed magnetic tables 5, in the contact area e,uns/a/ . The areas of the conveyor belt 4 marked with the numeral 7 indicate the points of the respective deepest sagging of the conveyor belt 4 in the median portion between the three support areas a on the three magnetic tables 5. The arrows 11 mark the travel direction of the magnetic tables 5 in the following working cycle (not shown in the drawing) of the coating machine or flat-bed screen printing machine.

It is easily conceivable that during each moving process, a continuous change of support areas (magnetic table 5, conveyor belt 4, stencil 8 and the therebetween located substrate web, not shown in the drawing) takes place. Relative to the stencils 8, 9, 10, or corresponding to the application process effectuated through the stencils 8, 9, 10, in each work cycle the standstill position of the magnetic tables 5 changes from a to b, and vice versa from b to a. It has already been mentioned in the introduction that various contact situation or contact times have quality or function impairing effects. It has to be explained in addition that the dimensions of the sagging of the conveyor belt 4 or of the substrate web in FIG. 3 have been shown greatly exaggerated, in order to make things clear. In practice, the sagging 7 amounts mostly to only a few cm, sometimes only a few mm. However, where there are high quality requirements, even relatively small sags can make a considerable difference in the quality.

Figure 4:
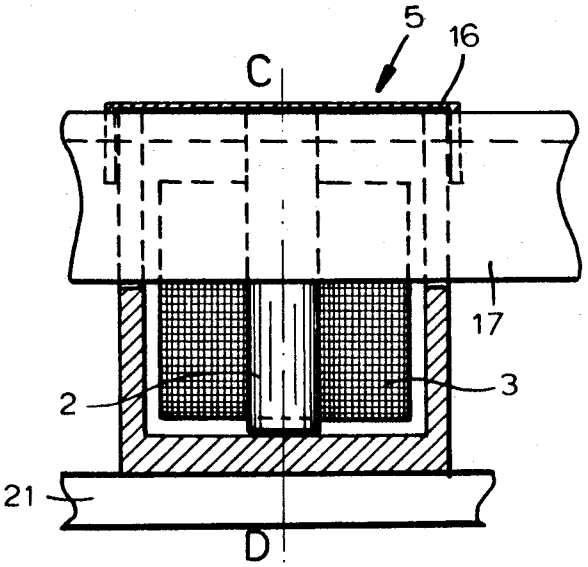
FIG. 4 is a cross-section through a magnetic table according to the invention.
Figure 6:
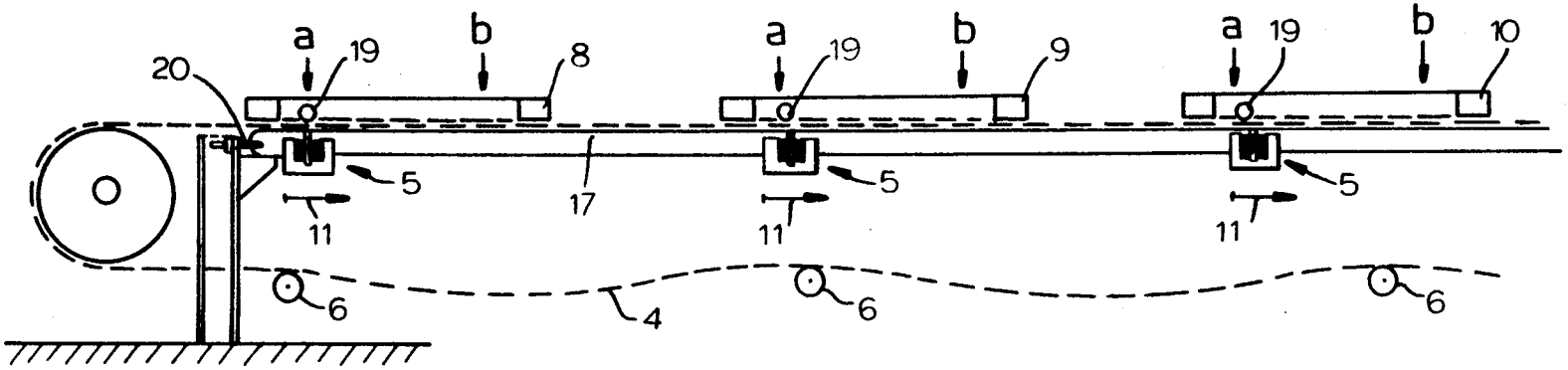
FIG. 6 is a diagrammatic side view of the machine according to the invention.

FIGS. 4 to 6 show representations analogous to FIGS. 1, 2 and 3, with the difference that in FIGS. 4 to 6 the object of the invention is also represented. Besides, in FIGS. 4 and 5, a cover 16 positioned or mounted on the magnetic table 5 is shown. FIGS. 4 and 6 show the invention in a longitudinal view. In FIG. 5 the object of the invention is shown three times with a T-shaped cross section, with a cover and in another variant without cover. In the first variant, the contact surface of the strip of the invention is plane parallel with the upper side of the plate 1 of the magnetic table 5, in the other variant, the contact or support surface is at the same level with the surface of the magnetic-table cover 16.

Both variants of the object of the invention are functionally effective to the same extent.

As shown in FIG. 5, according to the invention, in the magnetic table 5 between the individual magnet cores 2, cutouts 12 are provided to receive the inserted strips 17 or 18. At the insertions 17 there is also a cover 16, while the upper side of the insertion 18 lies at the level of the table surface. The insertions 17, 18 themselves are either profiled bars, but can also consist of a support strap. Concerning the cutouts 12, several variants are possible. In FIG. 5, an embodiment with a contactless cutout 12 is shown, but it is also conceivable that the support strap or profiled bar touches the cutout 12 with one or several portions of its surface and that due to this fact it is possible to achieve lateral guidance, respectively stabilization and/or also a load-bearing support (sliding guidance).

The profiled bars are tensioned at 20 on the machine frame. The squeegee, doctor blade or bars 19 cooperates with the magnetic tables 5 as described.

Also, it is not absolutely necessary that the cutouts 12 for the profiles be molded into the magnetic table 5. The magnetic table 5 can consist of several, mutually spaced magnetic table elements, whereby then these magnetic table elements rest on a common carrier beam 21 or any other carrier construction and the support straps or the profiled bars 17, 18 are then arranged in the interstices between the individual magnetic table elements. This carrier construction can also be provided with sliding or rolling guide for the support strap or profiled bar 17, 18.

FIG. 6 and the preceding explanation make clear that a coating machine, particularly a flat-bed screen printing machine built in accordance with the invention has a fully sag-free application surface, extending without any danger of sagging over the entire length, respectively also over the entire width of the coating machine, respectively flat-bed screen printing machine. Coating respectively printing machines built in accordance with the invention make possible to achieve higher coating quality than with the present state of the art. It also has to be added that construction variants according to the invention analogous to the here represented longitudinal direction of movement can be possible also for magnetic tables moved in transversal direction. Instead of a sliding layer (cover 16) is is also conceivable to use guide rods.

I claim:

1. A printing machine for coating a substrate web, said machine comprising:

a closed loop conveyor belt for displacing a substrate web to be coated along a printing path, said belt being formed with an inner side and with an outer side confronting the web;

at least one longitudinal profiled bar along said path and juxtaposed with said inner side of said conveyor belt;

means for holding said bar at opposite ends thereof;

application means for coating the web, said application means including:

at least one magnetic table movable along said path relative to said conveyor belt and formed with an upper face, said upper face being provided with receiving means accommodating said bar, and a magnetizable doctor blade facing the web to be coated and adapted to cooperate with said magnetic table upon displacing the latter in opposite directions along said path, said bar being in sliding contact with said inner side of said belt, so that the web to be coated is flat all along said path regardless of a direction of displacement of said web along said path wherein said receiving means includes a cutout formed in said magnet table and extending downwardly from said upper face, said bar being formed with a top side, said top side and said upper face being coplanar and being in continuous contact with said inner side of said conveyor belt along said path.

2. The printing machine defined in claim 1 wherein said table includes a plurality of said magnets extending transversely to said path and operatively connected with one another, a bar being provided between each two of said magnets.

3. The machine defined in claim 2 wherein said machine includes a plurality of said magnetic tables, said magnetic tables being spaced from one another along said path and being bridged by said bars.

4. The printing machine defined in claim 3, further comprising a carrier common to said magnetic tables.

5. The printing machine defined in claim 1 wherein said bar is a T-shaped bar.

6. The printing machine defined in claim 1 wherein said bar rests upon said table.

7. The printing machine defined in claim 1, further comprising a cover extending along said path and mounted between said upper face of said table flush with said top side of said bar and said magnetic table.

8. The printing machine defined in claim 7, further comprising a plurality of stencils facing the outer side of said belt carrying the web.

* * * * *